US012736238B2

(12) United States Patent
Su et al.

(10) Patent No.: US 12,736,238 B2
(45) Date of Patent: Sep. 15, 2026

(54) WICKLESS HUMIDIFIER

(71) Applicant: KONINKLIJKE PHILIPS N.V., Eindhoven (NL)

(72) Inventors: Wei Su, Eindhoven (NL); Ruben Arnold Herman Reekers, Eindhoven (NL)

(73) Assignee: VERSUNI HOLDING B.V., Eindhoven (NL)

( * ) Notice: Subject to any disclaimer, the term of this patent is extended or adjusted under 35 U.S.C. 154(b) by 530 days.

(21) Appl. No.: 18/267,740

(22) PCT Filed: Dec. 10, 2021

(86) PCT No.: PCT/EP2021/085327
§ 371 (c)(1),
(2) Date: Jun. 15, 2023

(87) PCT Pub. No.: WO2022/128828
PCT Pub. Date: Jun. 23, 2022

(65) Prior Publication Data

US 2024/0068680 A1 Feb. 29, 2024

(30) Foreign Application Priority Data

Dec. 16, 2020 (WO) ..... PCT/CN2020/136883
Jan. 25, 2021 (EP) ..... 21153175

(51) Int. Cl.
*F24F 6/16* (2006.01)
*F24F 13/22* (2006.01)
*F24F 6/00* (2006.01)

(52) U.S. Cl.
CPC ..... *F24F 6/16* (2013.01); *F24F 13/222* (2013.01); *F24F 2006/008* (2013.01)

(58) Field of Classification Search
CPC .... F24F 6/12; F24F 6/16; F24F 13/222; F24F 2006/008
(Continued)

(56) References Cited

U.S. PATENT DOCUMENTS 5,300,260 A * 4/1994 Keshet ..... B05B 17/0615 261/81
5,524,848 A * 6/1996 Ellsworth ..... F24F 6/12 454/157
(Continued)

FOREIGN PATENT DOCUMENTS

CN 103900155 A * 7/2014
CN 107035395 A 8/2017
(Continued)

OTHER PUBLICATIONS

Machine Translation of JP 5220325 A (Year: 1993).*
(Continued)

*Primary Examiner* — Charles S Bushey
(74) *Attorney, Agent, or Firm* — Maschoff Brennan

(57) ABSTRACT

A humidifier includes a water containing arrangement for containing water and a nebulizing device for nebulizing water from the water containing arrangement. Further, the humidifier includes an evaporation chamber arranged over the nebulizing device and the evaporation chamber terminates at an impactor. A fan is arranged to generate an air flow through the evaporation chamber towards the impactor. The impactor includes an inner body having a plurality of apertures, and an outer body having a plurality of further apertures fluidly connected to the plurality of apertures. The plurality of further apertures are offset relative to the plurality of apertures, such that each aperture of the plurality of apertures in the inner body faces a section of a material of the outer body that is spatially separated from the aperture
(Continued)

of the plurality of apertures. Further, described is an impactor for use with such a humidifier.

12 Claims, 8 Drawing Sheets

(58) Field of Classification Search
USPC ..... 261/81, DIG. 48
See application file for complete search history.

(56) References Cited

U.S. PATENT DOCUMENTS

| | | | | |
|---|---|---|---|---|
| 5,653,919 | A * | 8/1997 | White | B01F 23/213 261/21 |
| 7,490,815 | B2 * | 2/2009 | Tollens | B05B 17/0646 261/81 |
| 7,686,285 | B2 * | 3/2010 | Murray | B05B 17/0615 261/81 |
| 7,934,703 | B2 * | 5/2011 | Tomono | A61M 11/048 261/DIG. 65 |
| 8,070,138 | B2 * | 12/2011 | Saitou | A61H 33/065 261/78.2 |
| 2003/0042629 | A1 * | 3/2003 | Eom | F24F 6/12 261/142 |
| 2011/0034119 | A1 | 2/2011 | Mase et al. | |
| 2011/0226868 | A1 | 9/2011 | Modlin et al. | |
| 2018/0199627 | A1 | 7/2018 | Bowen et al. | |

FOREIGN PATENT DOCUMENTS

| | | | | |
|---|---|---|---|---|
| CN | 207035395 | U | | 2/2018 |
| CN | 207094797 | U | | 3/2018 |
| EP | 2787295 | A2 | | 10/2014 |
| GB | 2285680 | A | | 7/1995 |
| JP | 5220325 | A | * | 8/1993 |
| WO | 2010006969 | A1 | | 1/2010 |

OTHER PUBLICATIONS

Machine Translation of CN 103900155 A (Year: 2014).*
Umezawa, M., et al., "Effect of aerosol particles generated by ultrasonic humidifiers on the lung in mouse", Particle and Fibre Toxicology, vol. 10, Issue 1, pp. 1-10, Dec. 21, 2013.
Sain, A. E., et al., "Size and mineral composition of airborne particles generated by an ultrasonic humidifier", Indoor Air, vol. 28, Issue 1, pp. 80-88, 2017.
Hailu, N., et al., "Nebulization Criteria and Quantification", Fluids, pp. 1-19, Jun. 6, 2020.
Extended European Search Report issued in connection with corresponding EP Application No. 21153175.1 dated Jun. 29, 2021.

* cited by examiner

WICKLESS HUMIDIFIER

CROSS-REFERENCE TO RELATED APPLICATIONS

The present application is a U.S. National Phase application under 35 U.S.C. § 371 of International Application No. PCT/EP2021/085327, filed on Dec. 10, 2021, which claims the benefit of International Application No. PCT/CN2020/136883, filed on Dec. 16, 2020, and European Patent Application No. 21153175.1, filed on Jan. 25, 2021. This application is hereby incorporated by reference herein.

FIELD OF THE INVENTION

The present invention relates to a humidifier comprising a tray for containing water and a nebulizing device for nebulizing water from said tray; an evaporation chamber arranged over at least a portion of said tray, said evaporation chamber terminating at an impactor; and a fan arranged to generate an air flow through said evaporation chamber towards the impactor.

BACKGROUND OF THE INVENTION

Humidifiers are used to increase the relative humidity in an enclosed space, e.g. in a domestic or business setting. This for instance may be to compensate for humidity loss caused by ventilation or heating systems such as a central heating system, and may be desirable in order to avoid health issues such as dry skin, respiratory discomfort and the like.

A common design of such a humidifier is based on a cold evaporation principle, in which a wick or a similar material acts as a conduit between a water bath and a fan over the water bath, such that water evaporated from the wick gets propelled by the fan into the enclosed space in which the humidifier is positioned. This has the benefit that water vapor rather than larger size water droplets are expelled from the humidifier, but a drawback is that the wick can grow mould and become rather dirty over time, which is hard for a user to clean.

CN107035395 discloses a humidifier with a fan beneath the water container, an atomizer in the water container and an energy absorbing unit which floats at a particular height above the atomizer.

An alternative design of such a humidifier utilizes an ultrasonic transducer in contact with the water bath, in which the ultrasonic transducer generates small droplets and ejects these droplets into the air stream generated by the fan that spreads these droplets into ambient, where they can evaporate. This design does not significantly suffer from mould growth or other fouling, but has the disadvantage that contaminants in the water within the water bath are ejected within the water droplets into ambient, which is unhygienic. For example, A. E. Sain et al. in: "Size and mineral composition of airborne particles generated by an ultrasonic humidifier", Indoor Air, Volume 28(1), 2018, pages 80-88 (doi10:1111/ina.12414) describe the results of a study on the size distribution and concentration of particles expelled by a portable, 3 L ultrasonic humidifier. The ultrasonic humidifier was filled with waters of varying mineral content and hardness. Aerosol size distributions were measured during 8 h of humidifier operation in a typical bedroom. It was found that lower mineral waters produced fewer, smaller particles when compared to higher mineral waters. Chemical analyses of particles collected with a cascade impactor indicated that the minerals in emitted particles had the same relative mineral concentrations as the fill water, thus demonstrating that ultrasonic humidifiers should be considered a source of inhalation exposure to minerals dissolved in water, and that the magnitude of exposure to inhalable particles will vary with water quality. Although such exposure risks may be avoided by the use of filtered or distilled water, in practice most users tend to fill such humidifiers with tap water, thereby exposing people sharing a room with the humidifier when in operation to the mineral content in the tap water.

CN 207094797 discloses an air treatment module which has a water tank, a shower head above the water tank in a spray chamber, a pump to deliver water to the shower head and a fan assembly on top of the spray chamber. A water retaining plate is fitted before the fan assembly to avoid water droplets reaching the fan motor.

SUMMARY OF THE INVENTION

The present invention seeks to provide a humidifier that can operate using tap water whilst reducing the mineral content expelled by the humidifier.

According to an aspect, there is provided a humidifier comprising a water containing arrangement for containing water and a nebulizing device for nebulizing water from said water containing arrangement; an evaporation chamber arranged over at least a portion of said water containing arrangement, said evaporation chamber terminating at an impactor; and a fan arranged to generate an air flow through said evaporation chamber towards the impactor; wherein the impactor comprises an inner body having a plurality of apertures, and an outer body having a plurality of further apertures fluidly connected to said apertures, wherein said further apertures are offset relative to said apertures such that each aperture in the inner body faces a section of a material of the outer body that is spatially separated from said aperture.

The outlet flow from the fan enters the evaporation chamber at an entrance to the evaporation chamber and the flow drives through the evaporation chamber towards the impactor at the exit from the evaporation chamber.

The design of the impactor ensures that water vapor can escape the humidifier whereas (larger) droplets are caught by the impactor and prevented from escaping the humidifier. Consequently, contamination captured in such water droplets is prevented from escaping the humidifier, thereby reducing the health risks for people exposed to the humid air released from the humidifier. This is achieved due to the fact that the apertures in the inner body of the impactor speed up the air flow generated by the fan, causing a jet effect, which air jet is then diverted around the material portions of the outer body facing the apertures of the inner body owing to the fact that the further apertures are offset relative to the apertures. Due to the mass of water droplets passing through the apertures, the moment of inertia of these water droplets causes the droplets to collide with the material portions in the outer body facing such apertures, thereby capturing the water droplets and preventing them from exiting the impactor through the further apertures.

The plurality of apertures may be arranged in a plurality of spatially separated linear arrays of apertures and the plurality of further apertures may be arranged in a plurality of linear channels extending in the same direction as said linear arrays. As the further apertures simply provide exits from the impactor, they may be arranged as channels, thereby simplifying manufacturing complexity of the impactor and reducing its manufacturing cost.

In an embodiment, each section of said material of the outer body comprises a pair of opposing side walls extending along said linear channels towards the inner body. This further improves the effectiveness of the material sections in capturing water droplets due to an increased surface area of the material section and a reduced width of the fluid path between the apertures and the further apertures due to the side wall extending into this fluid path.

The impactor may have any suitable shape. For example, the impactor may have a cuboid or a cylindrical shape, which shape typically matches the shape of the housing of the humidifier.

The impactor may further comprise a plurality of drainage holes, each drainage hole being arranged to drain water collected by a section of the material of the outer body from the impactor. This ensures continuing functioning of the impactor, as the build-up of excessive water within the impactor due to the collection of water droplets by the material sections of the second body, which could impede the air flow from the apertures to the further apertures, is avoided.

To this end, the humidifier may further comprise at least one drainage channel extending from the impactor towards the water containing arrangement, wherein said drainage holes are aligned with said at least one drainage channel such that water trapped by the impactor can be reintroduced into the nebulizing device, e.g. via the water reservoir.

The inner body and the outer body of the impactor may extend in the same direction as said at least one drainage channel or may extend across the evaporation chamber. In other words, the impactor may be positioned in a vertical orientation, in which the further apertures are offset relative to the apertures in a vertical direction or the impactor may be positioned in a substantially horizontal orientation, in which the further apertures are offset relative to the apertures in a horizontal direction. In the latter embodiment, the inner and outer bodies preferably are curved or angled such that water droplets captured by the impactor can flow towards the sides of the impactor in order to facilitate draining of the water droplets from the impactor through its drainage holes.

The inner body and the outer body preferably are made of or coated with a hydrophobic material to promote the drainage of collected water droplets from the impactor.

In an embodiment, the water containing arrangement comprises a water tray in fluid communication with a water reservoir, with the nebulizing device being positioned in the water tray. This has the advantage that the water volume contained by the humidifier is increased, thus allowing for prolonged continuous operation before the humidifier needs to be replenished with water. The water reservoir may be in fluid communication with the water tray through a valve such as for instance a float valve responsive to a water level in the water tray or a solenoid valve such that a substantially constant water level can be maintained in the water tray.

In a preferred embodiment, the nebulizing device comprises a piezoelectrically actuated mesh structure for forming water droplets from the water in said water containing arrangement and expelling the formed water droplets into the evaporation chamber, as this allows for the formation of water droplets with a well-controlled droplet size, as the droplet size is typically governed by the size of the holes in the mesh. The mesh may be controlled by an actuator, which actuator may be configurable to adjust a vibration frequency, duty cycle and amplitude of the piezoelectric actuated mesh structure such that the rate at which water droplets are expelled by the mesh structure can be adjusted. For example, the nebulizing device may have a minimum water droplet expulsion rate of 1.6 L/h, which may be increased through control of the actuator.

In an example embodiment, the piezoelectrically actuated mesh structure is arranged over a chamber having a water inlet, said chamber comprising a sponge material arranged to transport water from the water inlet to the piezoelectrically actuated mesh structure to ensure a continuous water supply to the mesh structure. The sponge material may be removable from said chamber in order to clean or replace the sponge when necessary, e.g. for hygienic reasons. The chamber may further comprise a spring that compresses the sponge against the mesh structure to further ensure a continuous water supply to the mesh structure.

In accordance with another aspect, there is provided an impactor for use in the humidifier of any of the herein described embodiments, the impactor comprising an inner body having a plurality of apertures, and an outer body having a plurality of further apertures fluidly connected to said apertures, wherein said further apertures are offset relative to said apertures such that each aperture in the inner body faces a section of a material of the outer body that is spatially separated from said aperture. Such an impactor may be used with any type of humidifier that generates water droplets rather than water vapor and drives these water droplets to ambient with a fan, as the impactor when placed in the air stream generated by the fan that carries the water droplets can remove the water droplets from this air stream prior to exiting the humidifier, thus leaving only evaporated water in this air stream as explained in more detail above.

The plurality of apertures may be arranged in a plurality of spatially separated linear arrays of apertures and the plurality of further apertures may be arranged in a plurality of linear channels extending in the same direction as said linear arrays to yield an impactor having a simple design that can be manufactured in a cost-effective manner.

The impactor may further comprise a plurality of drainage holes, each drainage hole being arranged to drain water collected by a section of the material of the outer body from the impactor to ensure that collected water droplets are not retained by the impactor.

BRIEF DESCRIPTION OF THE DRAWINGS

Embodiments of the invention are described in more detail and by way of non-limiting examples with reference to the accompanying drawings, wherein.

DETAILED DESCRIPTION OF THE EMBODIMENTS

Figure 1:
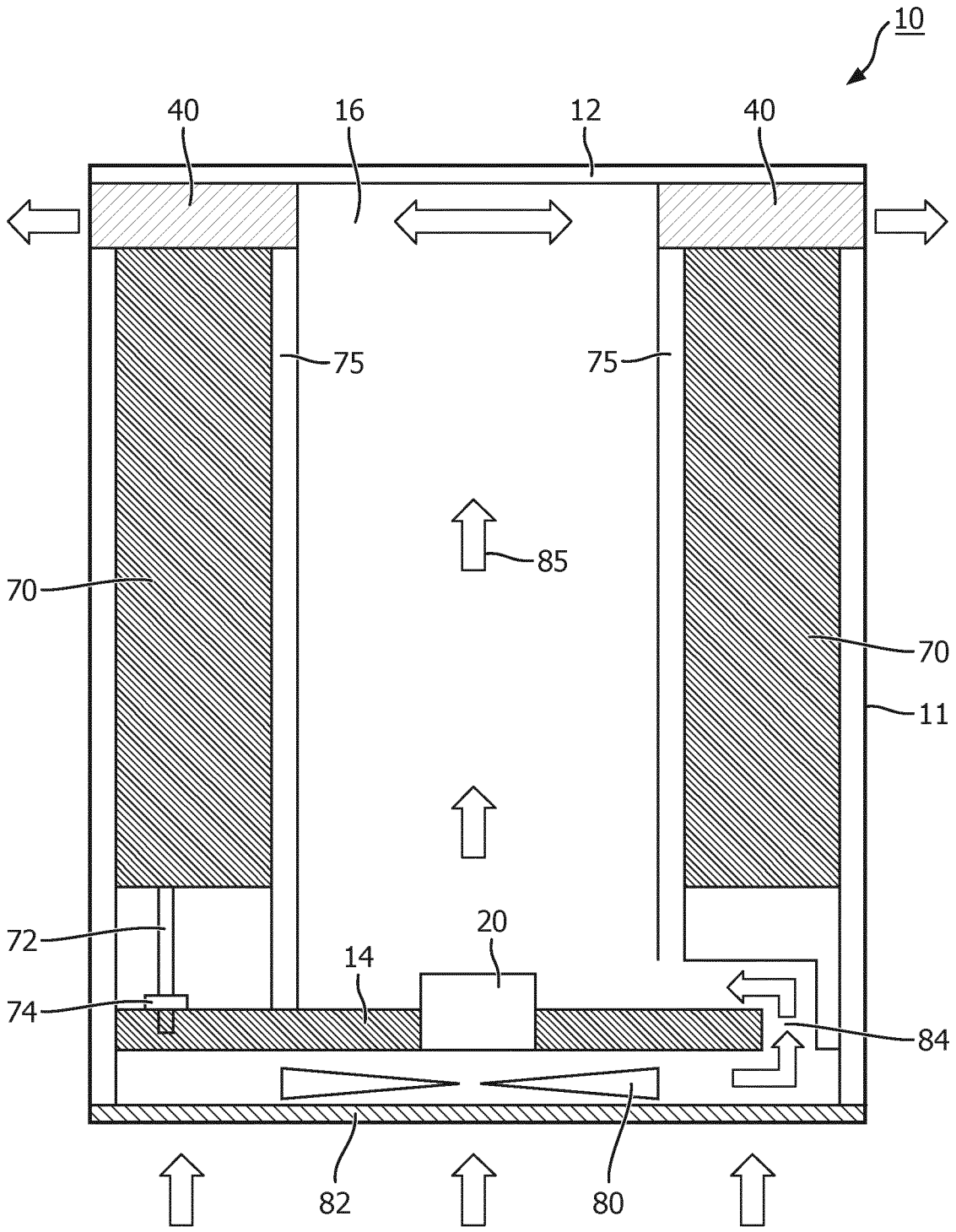
FIG. 1 schematically depicts a cross-sectional view of a humidifier according to an embodiment.

It should be understood that the Figures are merely schematic and are not drawn to scale. It should also be understood that the same reference numerals are used throughout the Figures to indicate the same or similar parts.

FIG. 1 schematically depicts a humidifier 10 according to an embodiment of the present invention. The humidifier 10 comprises a housing 11 in which a water containing arrangement including a tray 14 for holding water is positioned. The tray 14 may be the water reservoir of the humidifier 10, although preferably the water containing arrangement further comprises a water reservoir 70, e.g. a water tank or the like, which water reservoir 70 is fluidly coupled to the tray 14 to maintain the water level in the tray 14. For example, the water reservoir 70 may be fluidly coupled to the tray 14 through a valve such as a float valve 72 arranged to float on the water level contained by the tray 14, such that upon this water level dropping, the float valve 72 opens and allows water to flow from the water reservoir 70 to the tray 14, whereas upon the water level in the tray 14 having increased to a certain point, the float valve 14 shuts and blocks the flow of water from the water reservoir 70 to the tray 14. Other types of valves, e.g. a solenoid valve, may also be considered to fluidly couple the water reservoir 70 to the water tray 14.

A sensor (not shown) may be positioned in the water reservoir 70 or the tray 14, which sensor is adapted to monitor a water level in the water reservoir 70 or the tray 14 such that a controller (not shown) responsive to the sensor can cause the generation of an alert to alert a user of the humidifier 10 that the tray 14 or the water reservoir 70 needs replenishing. Such an alert may be generated in any suitable manner, and as the generation of such alerts is well-known per se, this will not be explained in further detail for the sake of brevity only. The water containing arrangement may be fluidly coupled to a mains water supply, e.g. through a float valve or the like to maintain a relatively constant volume of water in the water containing arrangement. Alternatively, a user may be required to manually top up the water containing arrangement.

A nebulizing device 20 is positioned in the tray 14 and is adapted to nebulize water from the tray 14 into water droplets that are expelled by the nebulizing device 20 into the evaporation chamber 16 that is arranged over at least a part of the tray 14 containing the nebulizing device 20. A fan 80, e.g. a centrifugal fan or axial fan, is arranged to draw air into the humidifier 10 through air inlets 82, which may be arranged in any suitable location, e.g. in the bottom of the humidifier 10 and/or in a side wall of the housing 11 of the humidifier 10. The fan 80 is fluidly connected to the evaporation chamber 16, e.g. through a conduit 84, and is adapted to generate an air stream as indicated by the block arrows through the evaporation chamber 16 in a direction from the tray 14 including the nebulizer 20 towards an impactor 40 under a roof 12 of the humidifier 10 through which the air stream is expelled into the ambient surroundings of the humidifier 10. During transport from the nebulizing device 20 to the impactor 40, at least some of the water droplets generated by the nebulizing device 20 may at least partially evaporate in the evaporation chamber 16 before reaching the impactor 40. In example embodiments, the fan 80 produces an air flow at a rate of 150-250 $m^3/h$ although other air flow rates are equally feasible depending on the size and application domain of the humidifier 10.

Figure 2:
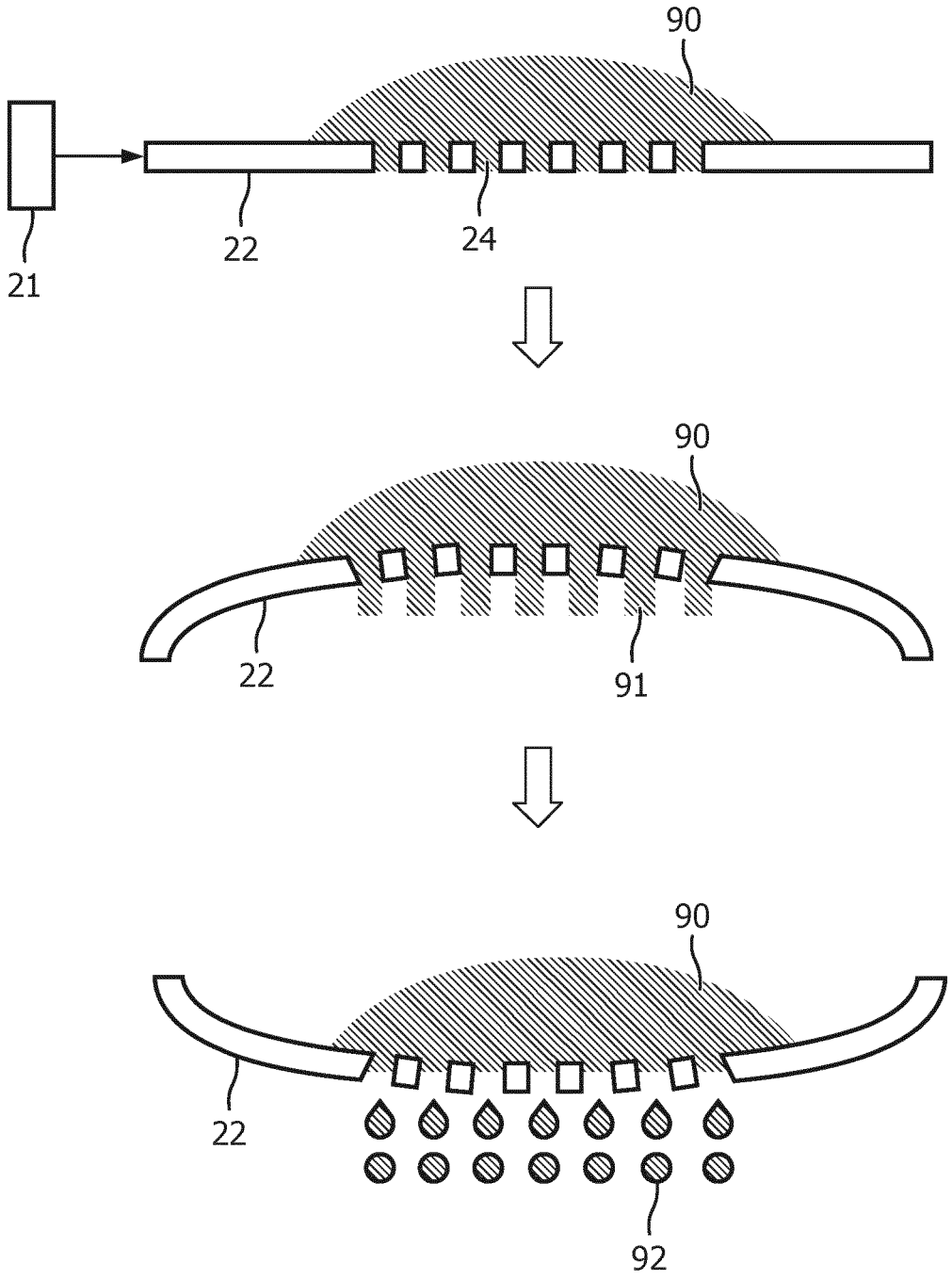
FIG. 2 schematically depicts the operating principle of a nebulizing device in cross-sectional view according to an example embodiment.

The nebulizing device 20 may be any suitable type of nebulizing device. In an example embodiment, which is schematically depicted in FIG. 2, the nebulizing device 20 comprises a piezoelectric mesh 22 driven by an actuator 21. The piezoelectric mesh during use is brought into contact with a volume of water 90 from the tray 14. The piezoelectric mesh 22 typically comprises a plurality of holes 24 having a defined diameter to control the size of the water droplets generated with the piezoelectric mesh 22. For example, the holes or pores 24 may be laser-drilled in a flexible metal sheet or the like, such that the holes or pores 24 have well-defined diameters to establish tight control over the size of the water droplets generated with the piezoelectric mesh 22, e.g. holes or pores 24 having a diameter in a range of 5-50 μm, e.g. in a range of 30-40 μm, for generating water droplets of correlated size. During operation, which is schematically depicted in FIG. 2, the actuator 21 causes the piezoelectric mesh 22 to vibrate, thereby forcing a column 91 of water through the holes 24 when the piezoelectric mesh 22 is flexed towards the water volume 90 and expelling the column 91 of water in the form of droplets 92 when the piezoelectric mesh 22 is flexed away from the water column 90. It is noted for the avoidance of doubt that during normal use of the nebulizer 20, the volume 90 of water is typically located below the piezoelectric mesh 22 such that the water droplets 92 are expelled upwardly from the piezoelectric mesh 22 into the evaporation chamber 16.

The actuator 21 may be adapted to vary the vibration frequency and amplitude of the piezoelectric mesh 22, which for example may be achieved by varying the voltage or pulse width supplied by a pulse width modulated actuator 21. To this end, the humidifier 10 may have a user interface (not shown) through which a user can set a water nebulization rate of the nebulizing device 20, directly or indirectly, which rate setting translates to a corresponding adjustment of the vibration frequency, amplitude or duty cycle of the piezoelectric mesh 22. In an example embodiment, the water nebulization rate of the nebulizing device 20 is at least 1.6 L/h to ensure sufficient humidifying of an enclosed space, e.g. a room or the like, in which the humidifier 10 is to be placed.

Figure 3:
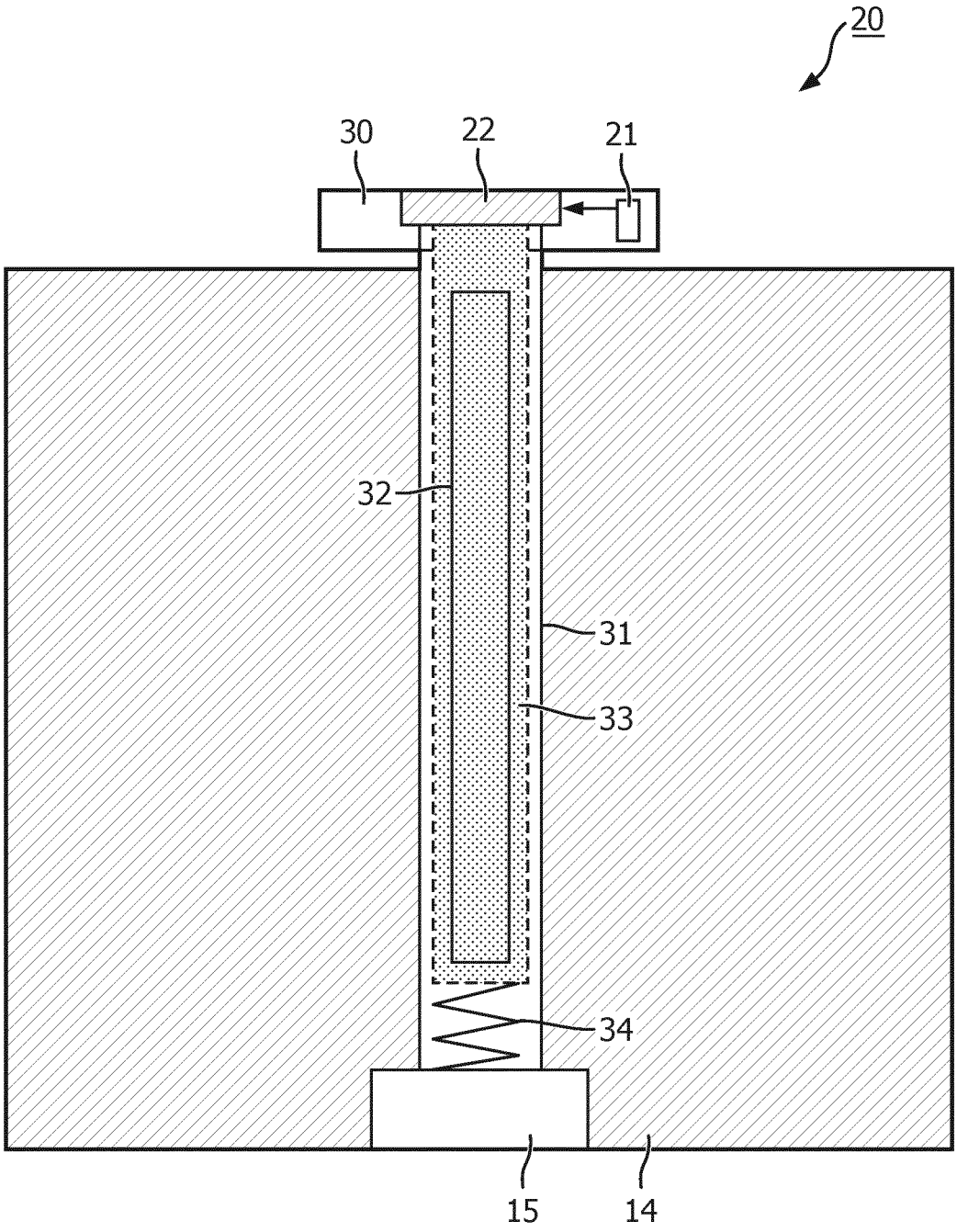
FIG. 3 schematically depicts a nebulizing device in cross-sectional view according to an example embodiment.

In an example embodiment schematically depicted in FIG. 3, the nebulizing device 20 comprises a chamber 30 containing a sponge 33 or the like such that water from the tray 14 can be absorbed by the sponge 33 through an aperture 32 in the housing 31 of the chamber 30. A spring 34 may be located at the bottom of the chamber 30 to press the sponge 33 against the piezoelectric mesh 22 such that the piezoelectric mesh 22 has access to the volume 90 of water provided by the sponge 33. To this end, the sponge 33 should have a water absorption rate at least matching the water nebulization rate of the nebulizing device 20. Preferably, the chamber 30 may be opened such that the sponge 33 can be removed from the chamber 30, e.g. for cleaning or replacement purposes, as over time the sponge 33 may become dirty, especially when tap water is used in the tray 14. The nebulizing device 20 may be secured in the tray 14 in any suitable manner. For example, the tray 14 may comprise a holder 15 or the like that engages with the nebulizing device 20 to keep it in place within the tray 14. Other suitable solutions will be immediately apparent to the skilled person. Of course, the design of the nebulizing device 20 is not particularly limited and any suitable nebulizing device 20 may be used for the humidifier 10. As such alternative nebulizing devices are well-known per se, this will not be explained in further detail for the sake of brevity only.

Figure 4:
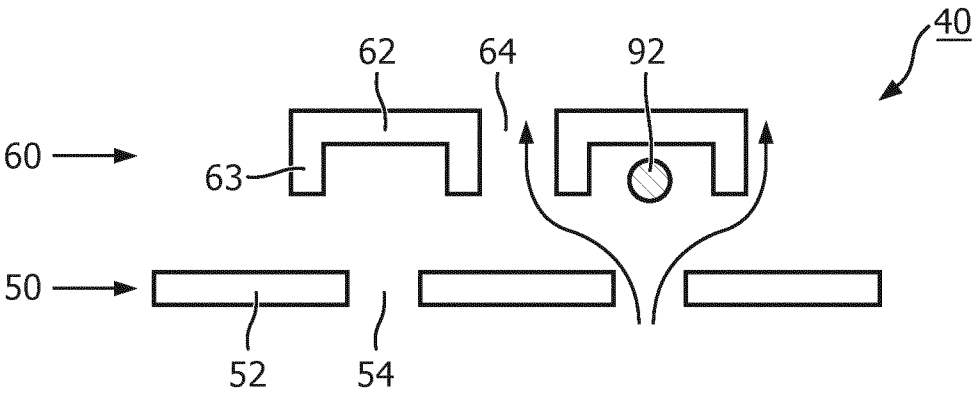
FIG. 4 schematically depicts an aspect of an impactor in cross-sectional view according to an example embodiment.

As explained above, the nebulizing device 20 produces water droplets 92 that are carried by the air stream produced by the fan 80 through the evaporation chamber 16 during which the water droplets 92 may at least partially evaporate during transport through the evaporation chamber 16. At the end of the evaporation chamber 16 distal to the tray 14, an impactor 40 is arranged that is adapted to capture the water droplets 92 that are still present in the air stream at that point. The impactor 40, which is schematically depicted in FIG. 4 and FIG. 5, comprises an inner body 50 facing the evaporation chamber, which inner body 50 comprises a plurality of apertures 54 in the material 52 of the inner body 50, which apertures 54 are dimensioned to block water droplets above a particular size from passing through the inner body 50 of the impactor 40.

The impactor 40 further comprises an outer body 60 arranged such that the inner body 50 is located in between the evaporation chamber 16 and the outer body 60. The outer body 60 comprises a plurality of further apertures 64 in the material 62 of the outer body 60, which further apertures 64 are offset relative to the apertures 54 such that each aperture 54 faces a material section 52 of the outer body that is spatially separated from the aperture 54. The inner body 50 and the outer body 60 are typically arranged such that each aperture 54 is fluidly coupled to at least one of the further apertures 64, that is, an air flow path exists between each aperture 54 and at least one of the further apertures 64, e.g. by spatially separating the inner body 50 from the outer body 60. In operation, when the air stream generated by the fan 80 (as indicated by the curved arrows) is forced through the apertures 54 of the inner body 50, the air stream is accelerated due to this force caused by the relatively small dimensions of the apertures 54, and diverted once the air stream has passed through the apertures 54 due to the offset positioning of the further apertures 64 relative to the apertures 54, as indicated by the curved arrows in FIG. 4. However, due to their moment of inertia, small water droplets 92 passing through an aperture 54 cannot divert quickly enough to reach one of the further apertures 64 and collide with the material section 62 of the outer body 60 instead, such that only water vapor carried by the air stream can escape the impactor 40 and the humidifier 10 as a consequence, thereby preventing contaminants that are typically contained by water droplets 92 from entering the ambient environment of the humidifier 10. To this end, the material portion 62 is preferably spatially separated from an opposing aperture 54 by a distance in a range of 5-10 mm although other distances may also be suitable, e.g. depending on the air flow rate generated by the fan 80.

The material sections 62 of the outer body 60 may further comprise one or more sidewalls 63 extending along the further apertures 64 towards the inner body 50 to improve the droplet capturing capability of the outer body 60. Although such sidewalls 63 preferably are spatially separated from the inner body 50, one of the sidewalls 63 of each material section 62 may instead extend onto the inner body 50, e.g. to strengthen the impactor 40, in which case each aperture 54 is typically connected to one or more further apertures 64 on one side of such a material section 62 only.

Figure 5:
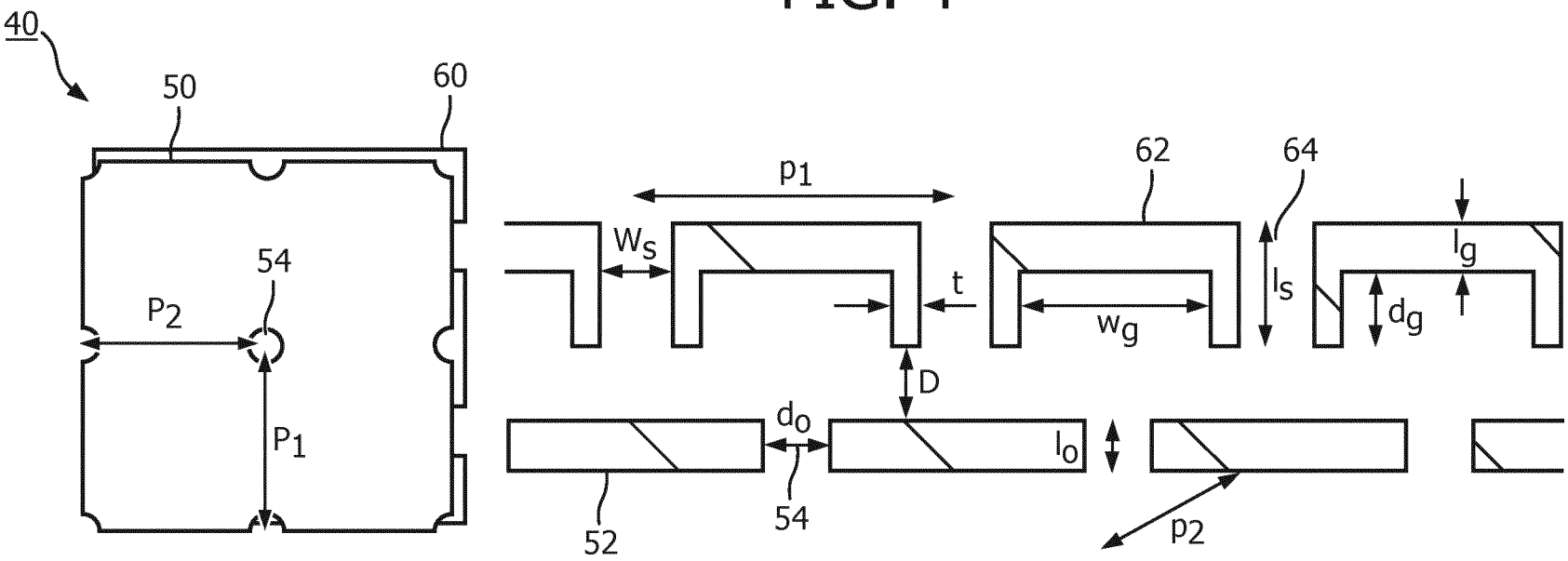
FIG. 5 schematically depicts relevant dimensions of the aspect of the impactor of FIG. 4.

FIG. 5 shows relevant dimensions of the impactor 40. In an example embodiment, these dimensions were chosen as per Table 1 below.

TABLE 1

Dimensions of the impactor 40

| Name | Symbol | Value (mm) | Tolerance (mm) |
|---|---|---|---|
| Gap | D | 4.0 | 0.3 |
| Radius | $0.5*d_0$ | 1.5 | 0.1 |
| Aperture width | $w_s$ | 4.0 | 0.2 |
| Aperture length | $l_0$ | 2.0 | 0.2 |
| Pitch | $p_1$ | 12.0 | 0.2 |
| Pitch | $p_2$ | 12.0 | 0.2 |
| Section thickness | $l_g$ | 2.0 | 0.2 |
| Section width | $w_g$ | 9.0 | 0.4 |
| Section depth | $d_g$ | 3.0 | 0.2 |
| Sidewall thickness | T | 1.0 | 0.2 |

The values in Table 1 are applicable for an impactor 40 used in a humidifier deploying a nebulizing device 20 producing water droplets having a diameter in a range of 30-40 μm and a fan 80 producing an air flow rate of around 170-200 $m^3/h$. Of course, it will be readily understood by the skilled person that the values of these parameters are shown by way of non-limiting example only, and may readily be adjusted if at least one of the droplet size produced by the nebulizing device 20 and the air flow rate produced by the fan 80 is adjusted.

Figure 6:
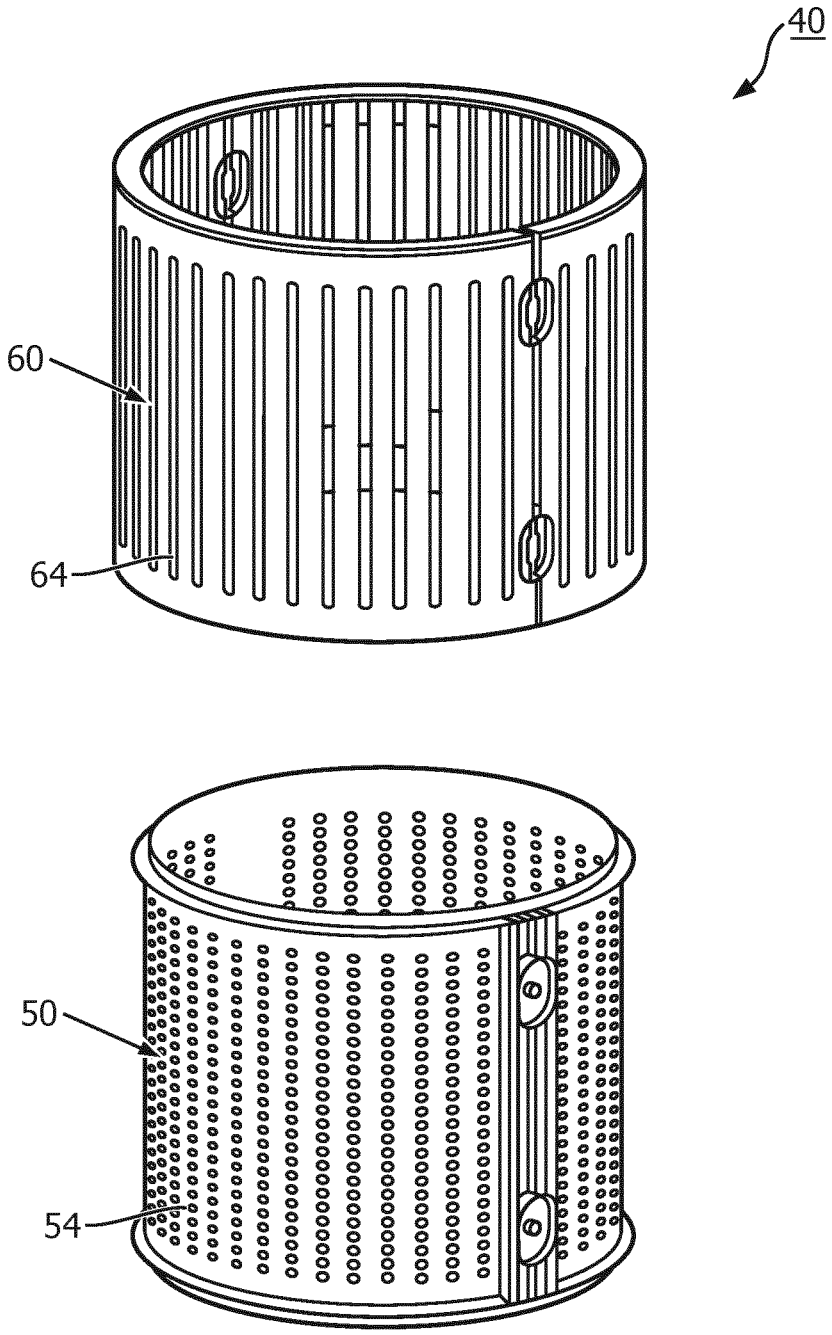
FIG. 6 schematically depicts an exploded view of an impactor.
Figure 7:
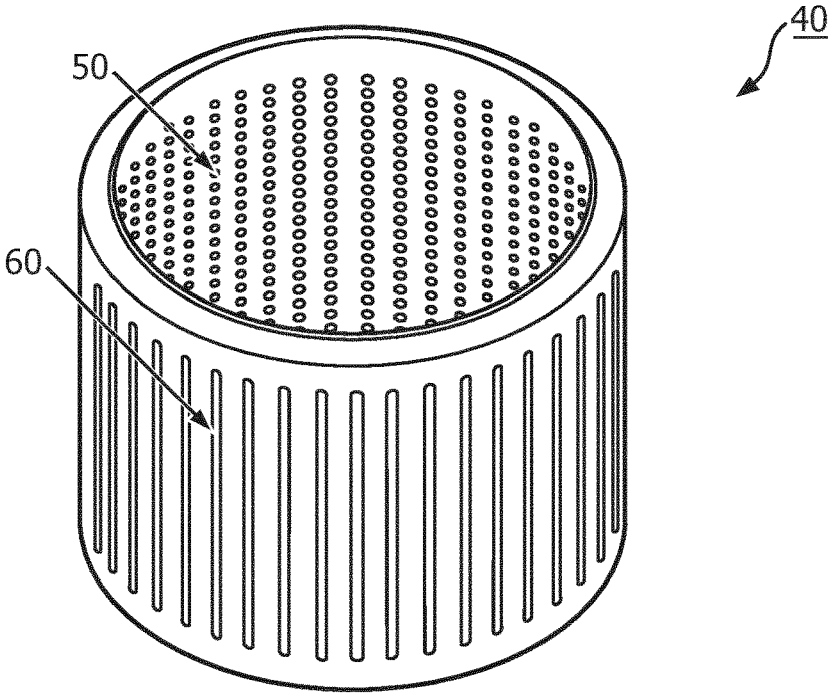
FIG. 7 schematically depicts a perspective view of an impactor.

FIG. 6 is an exploded view of an impactor 40 according to an example, in which both the inner body 50 and the outer body 60 have a cylindrical shape with the cylinder of the outer body 60 having a larger diameter than the cylinder of the inner body 50 such that the inner body 50 fits within the outer body 60 as schematically depicted in FIG. 7. In this example, the apertures 54 are grouped in linear arrays of apertures 54 that extend between the opposing edges of the cylindrical body 50. The further apertures 64 are shaped as elongate slots or channels that extend in the same direction as the linear arrays of apertures 54, i.e. between the opposing edges of the cylindrical outer body 60, which has the advantage that once the air stream generated by the fan 80 has passed through the further apertures 54, this air stream can pass through the channel-shaped further apertures 64 relatively unrestrictedly. Moreover, shaping the further apertures 64 in the form of slots or channels simplifies the manufacture of the outer body 60, thus reducing its cost. Of course, the impactor 40 is not limited to a cylindrical shape. Other shapes, e.g. a cuboid shape, are equally feasible, and may simply be chosen such as to match the shape of the housing 11 of the humidifier 10.

Figure 8:
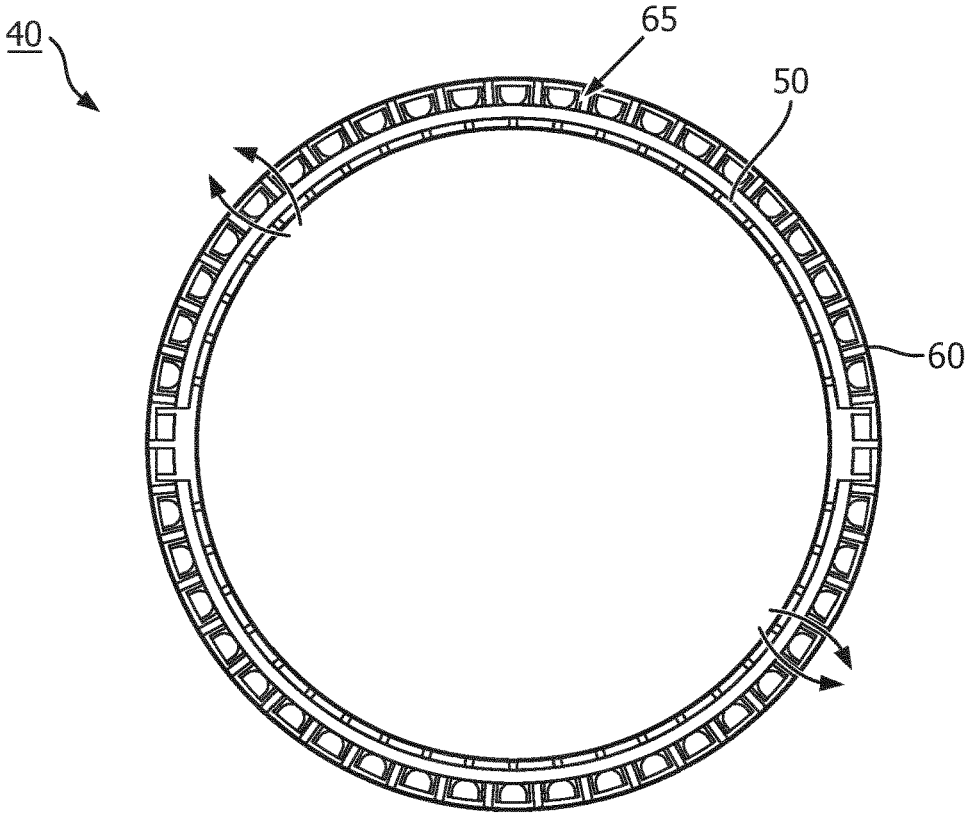
FIG. 8 schematically depicts a bottom view of an impactor.

FIG. 8 shows a bottom view of an impactor 40 according to an example, in which the impactor 40 further comprises drainage holes 65, which drainage holes 65 are arranged to drain water droplets 92 that are captured on the surface of the material sections 62 of the outer body 60 from the impactor 40. The drainage holes 65 for example may be located in a partition between the inner body 50 and the outer body 60, or may be incorporated into the design of the impactor 40 in any other suitable manner. In order to promote water drainage from the impactor 40, the inner body 50 and the outer body 60 may be hydrophobic, e.g. each of the inner body 50 and the outer body 60 may be made of a hydrophobic material such as a hydrophobic polymer, or may be coated with a hydrophobic layer such as hydrophobic polymer layer. As such hydrophobic materials are well-known per se, this will not be explained in further detail for the sake of brevity only.

Now, upon returning to FIG. 1, the humidifier 10 may further comprise one or more drainage channels 75 that extend from the impactor 40 towards the tray 14 such that water droplets 92 captured by the impactor 40, e.g. in between the inner body 50 and the outer body 60 may be returned to the tray 14. To this end, the drainage holes 65 of the impactor 40 are typically aligned with the at least one drainage channel 75 such that water drained from the impactor 40 through the drainage holes 65 is fed into the at least one drainage channel 75. The one or more drainage channels 75 may be hydrophobic, e.g. made from or coated with a hydrophobic material, to promote return of water drained from the impactor 40 to the tray 14.

Figure 9:
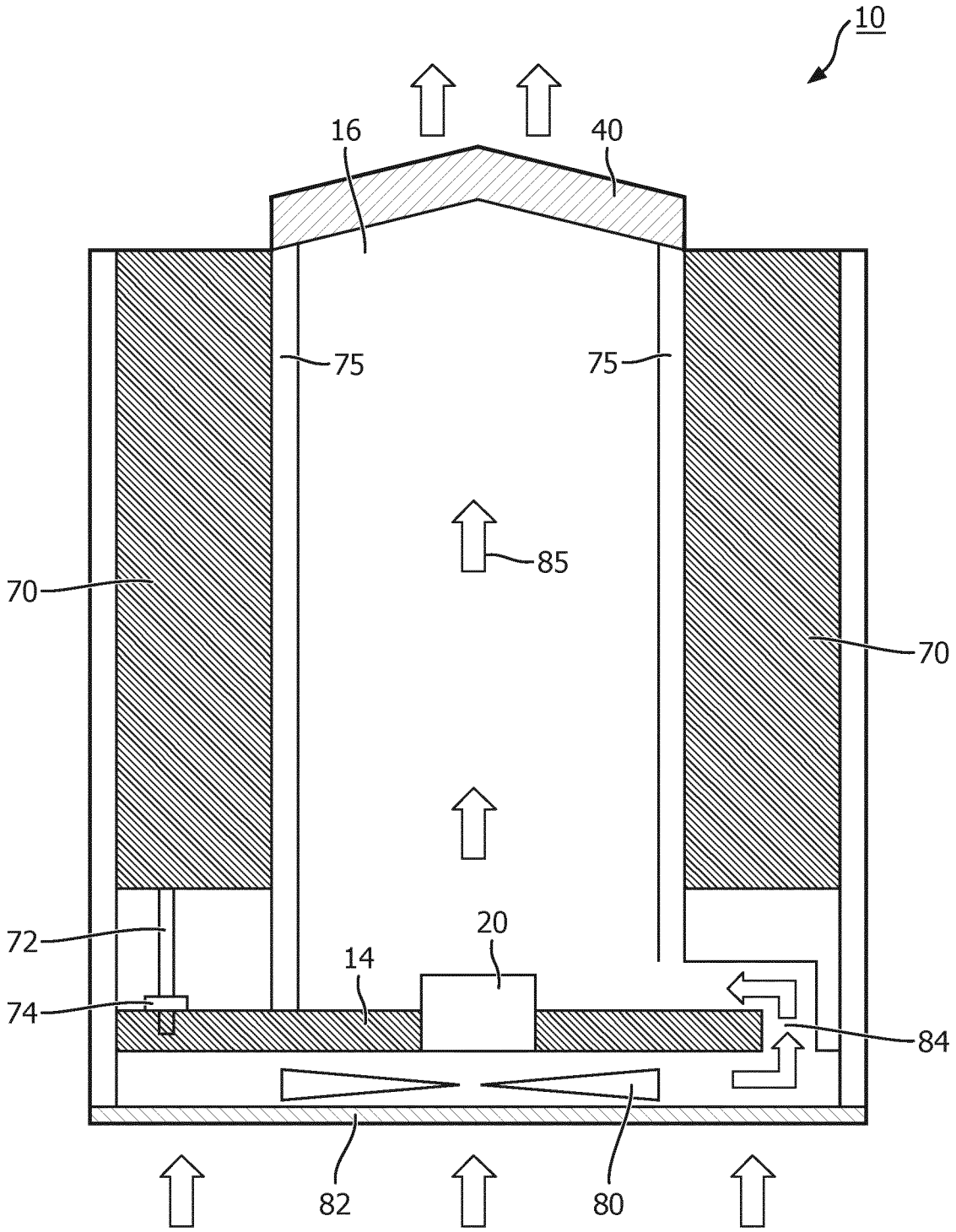
FIG. 9 schematically depicts a cross-sectional view of a humidifier according to an alternative embodiment.

In FIG. 1, the impactor 40 has a vertical orientation, that is, the inner body 50 and outer body 60 extend vertically during placement of the humidifier 10 on a horizontal surface. However, it is equally feasible for the impactor 40 to adopt a substantially horizontal orientation such that the inner body 50 and the outer body 60 extend across the evaporation chamber 16 as schematically depicted in FIG. 9. In this embodiment, the drainage holes 65 of the impactor 40 if present may be located in a peripheral region of the inner body 50 such that the drainage holes 65 may be aligned with the drainage channels 75 as previously explained. In this embodiment, in order to ensure efficient drainage of water captured in between the inner body 50 and outer body 60, the impactor 40 may have an angled shape (as shown) or a curved shape such that the water captured between the inner body 50 and outer body 60 flows from the centre of the impactor 40 to its periphery in which the drainage holes 65 are located.

Figure 10:
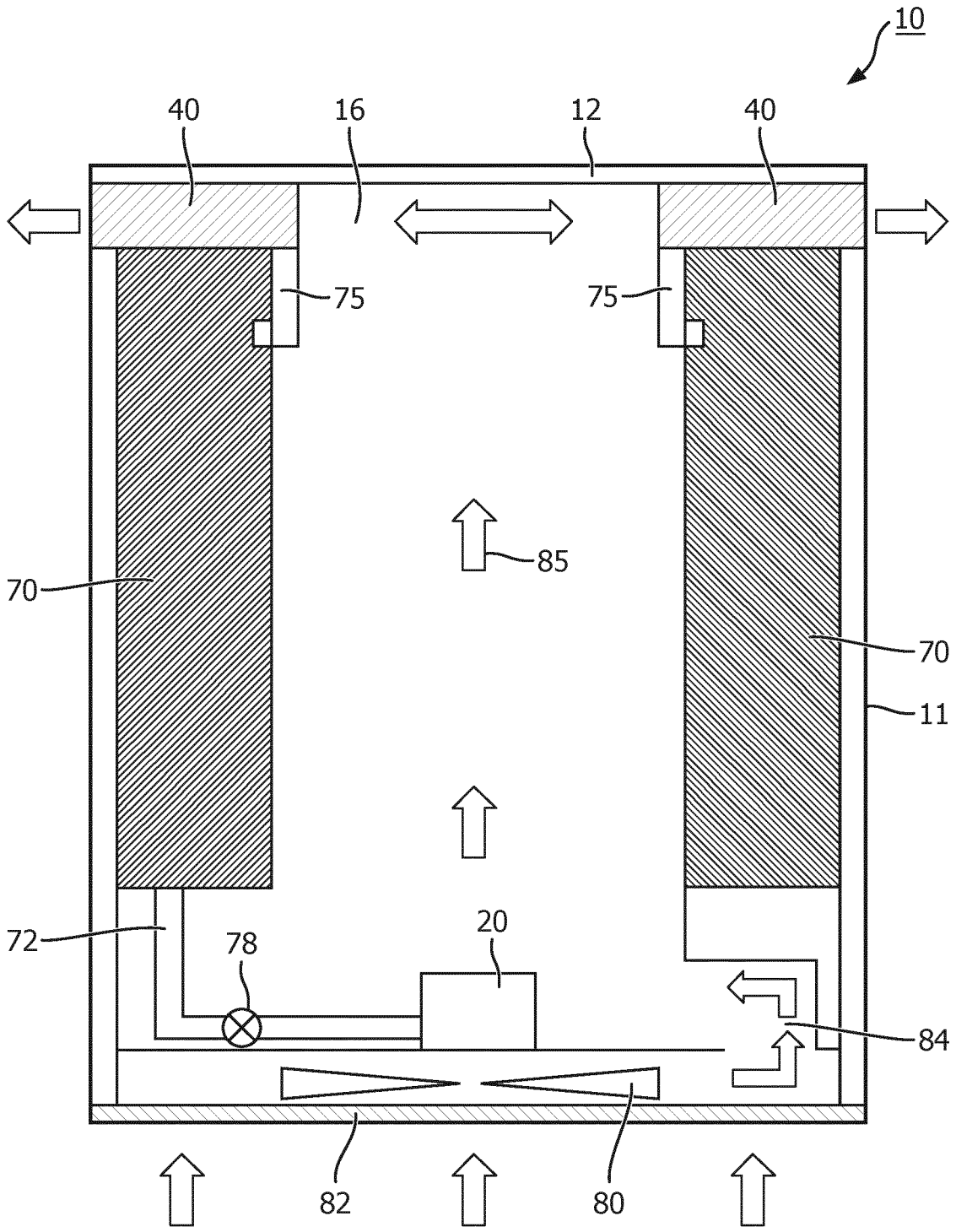
FIG. 10 schematically depicts a cross-sectional view of a humidifier according to yet another embodiment.

In the foregoing embodiments, the nebulizer 20 is positioned in the water tray 14, which is in fluid communication with the water reservoir 70. However, in an alternative embodiment schematically depicted in FIG. 10, the water tray 14 is omitted from the water containing arrangement and the nebulizer 20 is directly fluidly coupled to the water reservoir 70 through conduit 72, in which case water from the reservoir 70 may be gravity fed into the nebulizer 20 or may be pumped towards the nebulizer 20 using a pump 78 or the like. In this embodiment, the one or more drainage channels 75 may be arranged to reintroduce the water that is drained from the impactor 40 as explained above directly into the reservoir 70, as shown in FIG. 10.

In the foregoing description, the impactor 40 is shown as part of the humidifier 10. However, it should be understood that the impactor 40 may be provided as a standalone item, e.g. as a consumable, and may be used in conjunction with existing humidifiers, e.g. ultrasonic humidifiers, such that the expulsion of water droplets by such humidifiers is prevented by the addition of the impactor 40.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A humidifier comprising:

a water containing arrangement for containing water and a nebulizing device for nebulizing water from said water containing arrangement;

an evaporation chamber arranged over said nebulizing device, wherein said evaporation chamber terminates at an impactor; and a fan arranged to generate an air flow through said evaporation chamber towards the impactor, wherein the humidifier is configured to make an outlet flow from the fan enter the evaporation chamber at an entrance to the evaporation chamber, and wherein the impactor comprises an inner body having a plurality of apertures, and an outer body having a plurality of further apertures fluidly connected to said plurality of apertures, wherein said plurality of further apertures are offset relative to said plurality of apertures, such that each aperture of the plurality of apertures in the inner body faces a section of a material of the outer body that is spatially separated from said aperture of the plurality of apertures.

2. The humidifier of claim 1, wherein the plurality of apertures is arranged in a plurality of spatially separated linear arrays of apertures and the plurality of further apertures is arranged in a plurality of linear channels extending in a same direction as said plurality of spatially separated linear arrays of apertures.

3. The humidifier of claim 2, wherein each section of said material of the outer body comprises a pair of opposing side walls extending along said plurality of linear channels towards the inner body.

4. The humidifier of claim 1, wherein the impactor has a cuboid or a cylindrical shape.

5. The humidifier of claim 1, wherein the impactor further comprises a plurality of drainage holes, wherein each drainage hole being arranged to drain the water collected by the section of the material of the outer body from the impactor.

6. The humidifier of claim 5, further comprising at least one drainage channel extending from the impactor towards the water containing arrangement, wherein said plurality of drainage holes are aligned with said at least one drainage channel.

7. The humidifier of claim 6, wherein the inner body and the outer body extend in a same direction as said at least one drainage channel, or wherein the inner body and the outer body extend across the evaporation chamber.

8. The humidifier of claim 1, wherein the inner body and the outer body are made of or coated with a hydrophobic material.

9. The humidifier of claim 1, wherein the water containing arrangement comprising a water tray in fluid communication with a water reservoir, wherein the nebulizing device is positioned in said water tray.

10. The humidifier of claim 1, wherein the nebulizing device comprises a piezoelectrically actuated mesh structure for forming water droplets from the water from said water containing arrangement and expelling the formed water droplets into the evaporation chamber.

11. The humidifier of claim 10, wherein an actuator of said piezoelectrically actuated mesh structure is configurable to adjust a vibration frequency of the piezoelectrically actuated mesh structure.

12. The humidifier of claim 10, wherein the piezoelectrically actuated mesh structure is arranged over a chamber having a water inlet, wherein said chamber comprising a sponge material is arranged to transport the water from the water inlet to the piezoelectrically actuated mesh structure, and wherein said sponge material is removable from said chamber.

* * * * *